US010327525B2

(12) United States Patent
Deng

(10) Patent No.: US 10,327,525 B2
(45) Date of Patent: Jun. 25, 2019

(54) MULTIFUNCTIONAL CARD HOLDER

(71) Applicant: GOVO LLC, Solon, OH (US)

(72) Inventor: Haishan Deng, Solon, OH (US)

(73) Assignee: GOVO LLC, Solon, OH (US)

( * ) Notice: Subject to any disclaimer, the term of this patent is extended or adjusted under 35 U.S.C. 154(b) by 0 days.

(21) Appl. No.: 15/886,499

(22) Filed: Feb. 1, 2018

(65) Prior Publication Data

US 2019/0008253 A1 Jan. 10, 2019

Related U.S. Application Data

(63) Continuation-in-part of application No. 29/609,763, filed on Jul. 5, 2017, now Pat. No. Des. 831,349.

(51) Int. Cl.

| | |
|---|---|
| ***A45C 1/06*** | (2006.01) |
| ***A45C 11/18*** | (2006.01) |
| ***A45F 5/02*** | (2006.01) |

(52) U.S. Cl.

CPC ..... *A45C 11/182* (2013.01); *A45C 1/06* (2013.01); *A45F 5/021* (2013.01); *A45C 2001/062* (2013.01); *A45C 2001/067* (2013.01); *A45C 2200/10* (2013.01); *A45F 2200/055* (2013.01)

(58) Field of Classification Search

CPC ..... A45C 11/182; A45C 1/06; A45C 5/021; A45C 2001/062; A45C 2004/067; A45C 2200/10; A45C 2200/055

See application file for complete search history.

(56) References Cited

U.S. PATENT DOCUMENTS

| | | | | | |
|---|---|---|---|---|---|
| 953,953 | A | * | 4/1910 | Inglee | B65D 83/12 206/39.3 |
| 1,064,839 | A | * | 6/1913 | Gattle | A45F 5/022 24/3.12 |
| 1,392,661 | A | * | 10/1921 | Seese | G09F 13/04 40/649 |
| 3,623,189 | A | * | 11/1971 | Wilczynski | A45F 5/02 24/3.11 |
| 4,305,497 | A | * | 12/1981 | Pacilio | G07D 1/08 206/0.81 |
| 4,903,745 | A | * | 2/1990 | Roman | A45C 1/04 150/134 |
| D372,358 | S | * | 8/1996 | Mathison | D11/78.1 |
| 5,718,329 | A | * | 2/1998 | Ippolito | A45C 11/182 150/147 |

(Continued)

*Primary Examiner* — Tri M Mai

(74) *Attorney, Agent, or Firm* — Weintraub Tobin; Zheng "Andy" Liu

(57) ABSTRACT

The present disclosure provides example multifunctional card holders as well as systems and methods for manufacturing the same. An example multifunctional card holder may comprise: a transparent screen that is attached to a back piece, a spring inside a card holding space between the transparent screen and the back piece, the back piece; and a clip attached to the back piece outside the card holing space. The spring is of a curvy shape with two ends connecting to the back piece so as to hold one or more cards inside the card holding space by pushing one or more cards against the transparent screen. The clip includes a clip opening configured to be mechanically connected to an item of a user. The clip may also serve as a cash clip with a clip arm holding one or more cash bills against the back piece.

18 Claims, 15 Drawing Sheets

(56) References Cited

U.S. PATENT DOCUMENTS

| | | | | |
|---|---|---|---|---|
| 5,901,764 | A * | 5/1999 | Ritter | A45C 11/182<br>150/147 |
| 7,334,616 | B2 * | 2/2008 | Kaminski | A45C 11/182<br>150/147 |
| 7,830,672 | B1 * | 11/2010 | Kitchen | A45C 11/182<br>174/350 |
| 7,921,890 | B2 * | 4/2011 | Ho | A45C 11/182<br>150/134 |
| 2003/0217936 | A1 * | 11/2003 | Nourian | A45C 11/18<br>206/39 |
| 2017/0135452 | A1 * | 5/2017 | Kane | A45C 11/182 |

* cited by examiner

MULTIFUNCTIONAL CARD HOLDER

REFERENCE TO RELATED APPLICATIONS

This application is a continuation-in-part of the U.S. Design patent application Ser. No. 29/609,763, filed Jul. 5, 2017, and entitled "ID Card Holder," which is hereby incorporated by reference in its entirety.

TECHNICAL FIELD

The present disclosure generally relates to a personal item organizer and more specifically to a multifunctional card holder.

BACKGROUND

Users often carry multiple cards, such as an ID badge, one or more credit cards, and a driver license at the same time when handling their daily routines. A card holder may therefore need to provide a way to conveniently carry these multiple cards as well as other relevant functionalities.

Many card holders do not provide a convenient storage of multiple types of cards. Because different cards may require different types of storages in a card holder. For example, an ID badge may be better stored in a transparent and detachable card holder because the ID badge is often used by showing to others or scanning across a sensor. A credit card may be better stored in a pocket that allows convenient retrieval because a credit card needs to be taken out from its pocket and swiped through a card reader every time it is used. A driver license may be better stored in a non-transparent container or in between other cards in order to shield private information included thereon from the general public. The designs of most current card holders, however, have not incorporated users' storage preferences towards different types of cards.

Second, some card holders do not provide enough flexibility for users to carry the card holders conveniently in ways that they prefer. For example, the cardholder disclosed in U.S. Pat. No. 8,662,293 can only be carried via a lanyard, which may not be a convenient means in many occasions. The cardholder disclosed in U.S. Pat. No. 4,869,004 needs to be carried by a brooch or a clamp which tends to damage clothes.

Third, the connection piece for securing a card holder to a user is often either flimsy and thus fragile or bulky and thus inconvenient. For example, the cardholder disclosed in U.S. Pat. No. 6,226,905 requires an additional structure outside the body of the card holder. The connection between the additional structure and the card bolder body may be fragile and easy to break.

Fourth, when users assemble all the cards in one deck and retrieve different cards from time to time, the thickness of the card deck changes, sometime irreversibly. A card holder with fixed dimensions and open ends do not handle well the frequent changes of a card deck and, as a result, cards may be lost. For example, the card holder disclosed in U.S. Pat. No. 8,662,293 uses plastic retainer clips to maintain multiple cards inside the card holder, which tends to become looser in shape after a certain amount of usage and cards may accidentally fallout of the card holder.

Lastly, in addition to cards, users often carry other personal items, such as keys and paper currencies, in addition to cards. It may be time consuming to locate a particular personal item from a card holder that includes several different kinds of personal items. Disorganized personal items tend to become misplaced, lost, or stolen.

The above identified problems are reduced or eliminated by the apparatuses disclosed in the present disclosure.

BRIEF DESCRIPTION OF THE DRAWINGS

FIGS. 1-9 illustrate a first card holder embodiment. FIGS. 10-11 illustrate a second card holder embodiment. FIGS. 11-12 illustrate a third card holder embodiment.

Figure 1:
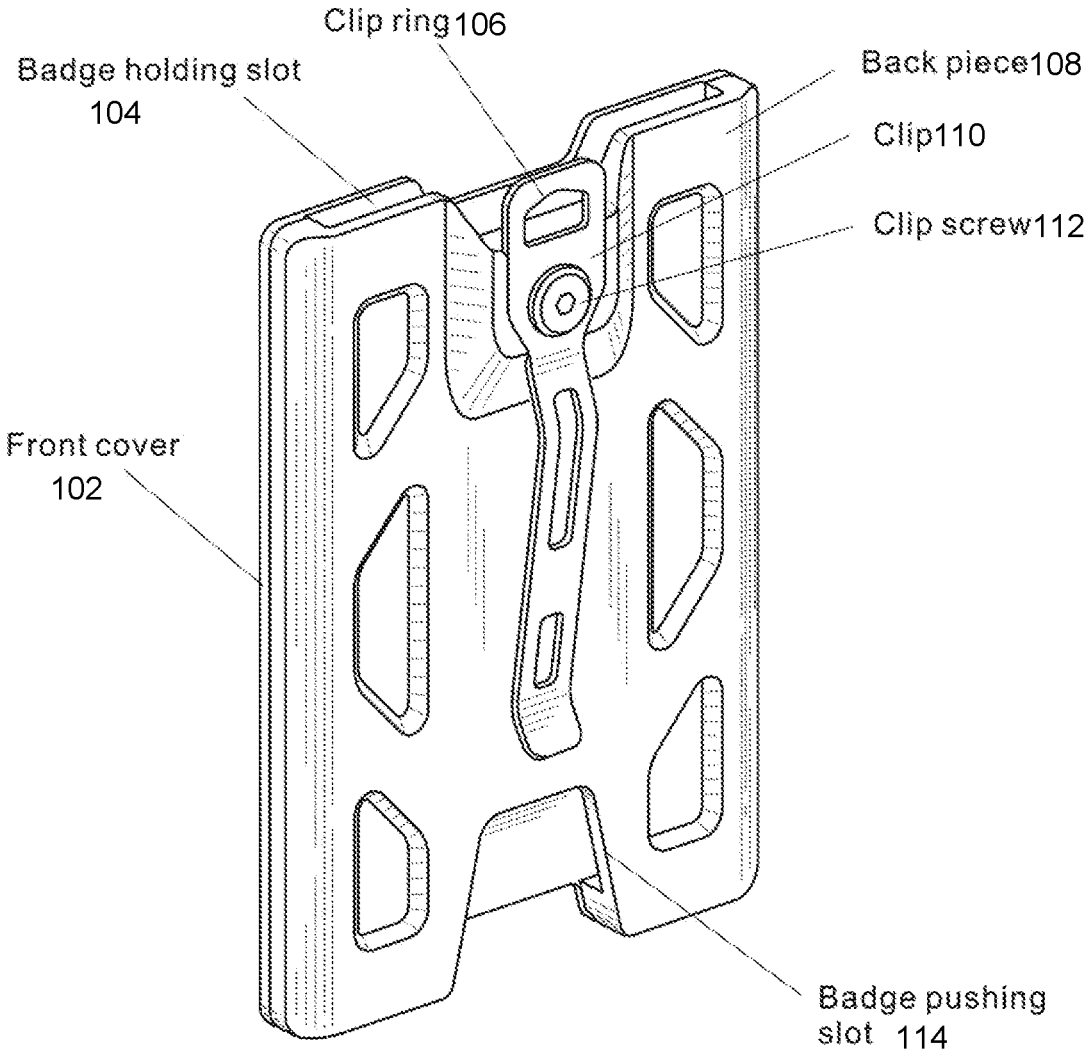
FIG. 1 is a block diagram illustrating a perspective rear view of an example multifunctional card holder.

Embodiments of the present disclosure and their advantages are best understood by referring to the detailed description that follows. It should be appreciated that like reference numerals are used to identify like elements illustrated in one or more of the figures; showings therein are for purposes of illustrating embodiments of the present disclosure and not for purposes of limiting the same.

SUMMARY

Embodiments of multifunctional card holders, as well as method and computer executable instructions for manufacturing the multifunctional card holders, are provided in the present disclosure.

A multifunctional card holder, in some implementations, comprises: a transparent screen that is attached to a back piece, a spring inside a card holding space between the transparent screen and the back piece, the back piece; and a clip attached to the back piece outside the card holding space. The spring is of a curvy shape with two ends connecting to the back piece so as to hold one or more cards inside the card holding space by pushing one or more cards against the transparent screen. The clip includes a clip opening configured to be mechanically connected to an item of a user.

In some implementations, the screen is rigid and attached to the back piece via one or more securing screws. The screen may be made of transparent polycarbonate and the screws may be made of steel.

In some implementations, the transparent screen and the back piece are of a rectangular shape except that one edge of the back piece includes an indented card pushing slot so that a user may retrieve a card from the card holding space from the slot.

In some implementations, the spring is configured to hold two or more cards inside the card holding space. Further, the card holding space may be configured to hold a RFID blocking card and one or more identification or payment cards.

In some implementations, the spring is made of elastic metal.

In some implementations, the spring is a single "n" shape metal piece. The first metal portions at parallel sides of the "n" shape are of an arch shape and the second metal portion connecting the first metal portions is of a linear shape.

In some implementations, the spring includes two "n" shape ends that are inserted into two spring position slots in the back piece. The transparent screen may include one or more inserts which are positioned inside the space between the spring and edges of the back piece to hold the spring. For example, the transparent screen may include two inserts and each insert includes a spring holding slot. Both spring holding slots in the screen may be positioned to work with the two spring positioning slots in the back piece to hold the two ends of the spring.

In some implementations, the back piece includes one or more hollowed-out regions.

In some implementations, the clip is made of an elastic material.

In some implementations, the clip is attached to the back piece by a screw-nut structure.

In some implementations, the clip includes a clip arm to press one or more cash bills against the back piece. When the card holder is configured into a rectangular shape, such clip may be perpendicular to either the short or the long edge of the card holder. The clip can be used to, among other things, attach the card holder to a user's belt or clothes.

In some implementations, the clip excludes the clip arm to make the card holder lighter and slimmer.

A computer-implemented method for manufacturing the multifunctional card holder as described in any of the implementations above.

A non-transitory computer readable medium comprising computer executable instructions stored thereon, which, when executed by one or more computers, cause a machine to manufacture the multifunctional card holders as described in any of the implementations above.

DETAILED DESCRIPTION

The present disclosure provides example multifunctional card holders as well as systems and methods for manufacturing the same. The multifunctional card holders described in the present disclosure not only allow users to use and store different types of cards conveniently and safely but also help users to organize other personal items together with the cards.

The technologies described in the present disclosure can provide the following technical advantages. First, the multifunctional card holders facilitate the storage and use of different types of cards. For example, ID badges may be used without being taken out of the card holders. Credit cards may be retrieved easily. Driver license may be stored in the middle of other cards so as to protect private information on the license. Second, the multifunctional card holders can hold tight onto one or more cards to prevent cards from losing or being stolen. Third, the multifunctional card holders may be easily attached to and detached from users to facilitate the scanning of ID badges. Fourth, the multifunctional card holders may be used as personal item organizers to assemble articles of daily use in one place with cards. Additional details of implementations are now described in relation to the Figures. The present disclosure uses term "badge(s)" and "card(s)" interchangeably because badges are mechanically representative of cards and can be used to explain some specific functions of the card holders.

FIG. 1 is a block diagram illustrating a perspective rear view of an example multifunctional card holder.

Figure 3:
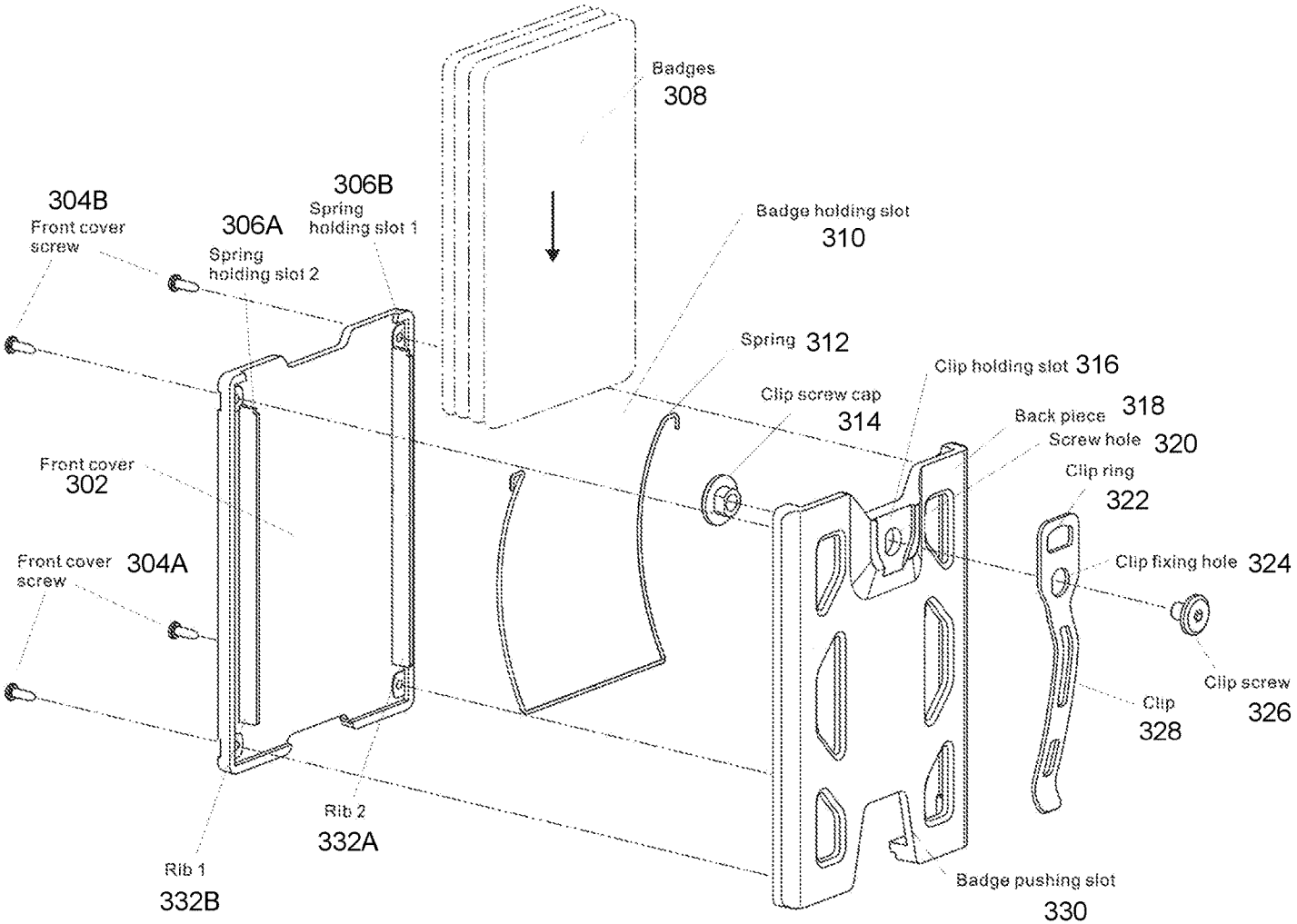
FIG. 3 is a block diagram illustrating a perspective view of individual parts in an example multifunctional card holder with the individual parts arranged in such an orientation readily to be assembled.

As shown in FIG. 1, a multifunctional card holder embodiment 10 comprises a front cover 11, a back cover 12, a clip 14 and a spring which is hidden inside a card holding slot 13 and will be shown in FIG. 3.

The front cover 11 is attached to the back cover 12 to form a card holding slot 13. A clip screw 16 may secure the clip 14 to the back cover 12 outside the card holding slot 13. The clip screw 16 makes a secure and durable connection between the badge holder and its user. The clip 14 further includes a slot 15.

As shown in FIG. 1, both the front cover 11 and the back cover 12 may be configured into a rectangular shape to fit the size of most standard cards. The back cover 12 may include an indented ejecting slot 18 that allows a user to push cards out of the card holding slot 13 conveniently.

Figure 2:
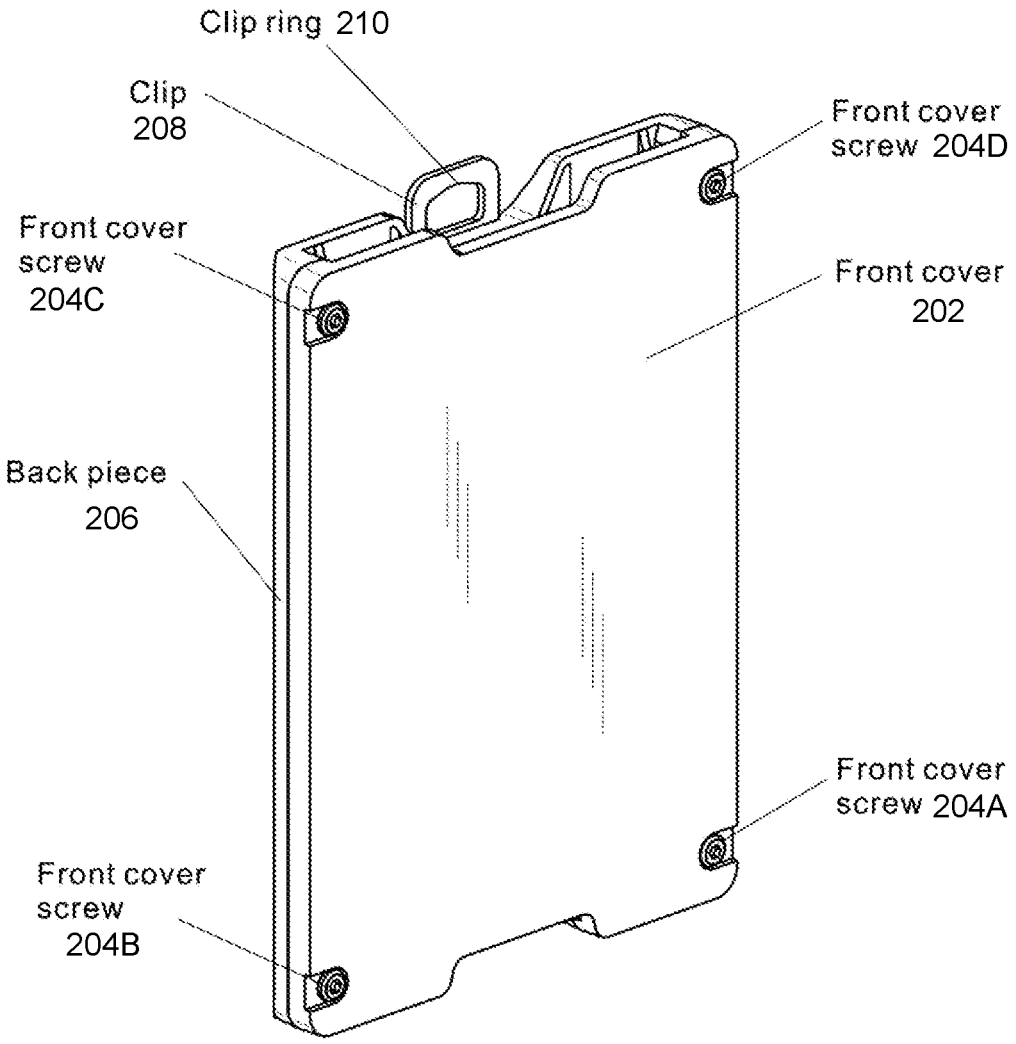
FIG. 2 is a block diagram illustrating a perspective front view of an example multifunctional card holder.

FIG. 2 is a block diagram illustrating a perspective front view of an example multifunctional card holder.

As shown in FIG. 2, an example card holder 10 includes a front cover 11, a back cover 12 and a clip 208 with a slot 15. The front cover 11 is transparent to facilitate the display of an ID badge. FIG. 2 further shows that the front cover 11 and the back cover 12 may be secured by screws 25 to improve the durability of the card holder. To provide increased durability and badge protection, the front cover 11 may be made of rigid and strong material, such as transparent polycarbonate and the screws 25 may be made of steel.

FIG. 3 is a block diagram illustrating a perspective view of individual parts in an example multifunctional card holder with the individual parts arranged in such an orientation readily to be assembled.

As shown in FIG. 3, an example card holder 10 includes a front cover 11, a curvy spring 19, a back cover 12 with an ejecting slot 18, and a clip 14 having a slot 15, a clip fixing hole 22 and a clip arm. Screws 25 may secure the front cover 11 with the back cover 12. A clip screw 16 may screw through a hole 23 in the back cover 12 and screw with a clip screw cap 17 to secure the clip 14 into clip holding slot 24 of the back cover 12.

The card holding slot 13 may hold one or more badges 30 such as ID badges, credit cards, and driver licenses. A user may also insert an RFID blocking card to protect credit card information from unauthorized data access. Most ID badges use low frequency to communicate with sensor and most unauthorized data accesses entail the use high frequency signals to access and copy data from credit cards. A user who intends to use the card holder to store both ID badges and credit cards may use a RFID blocking card that only blocks high frequency signal so as to protect her credit card data while not blocking low frequency ID badge signals, which are often used to conduct legitimate credit transactions.

Spring 19 is an example structure for maintaining badges 30 tightly against the front cover 11 even when the thickness of the badge deck changes. Spring 19 may be made of any elastic material including elastic metal.

Spring 19 may be configured in any curvy shape and connected to the back cover 12 by any means. FIG. 3 shows an example spring 19 of a single "n" shape metal piece. The "n" shape metal piece includes a first metal portion at parallel sides of the "n" and a linear second metal portion connecting the first metal portions. The first metal portions are configured into an arch shape so as to keep one or more cards pressed tightly against the transparent front cover 11 even when the thickness of the card deck varies.

The spring 19 includes two "n" shape ends, which may be inserted into two spring positioning slots included in the back cover 12. To further secure the spring 19, the front cover 11 may include one or more inserts positioned to fit inside the space between the spring 19 and the edges of the back cover 12.

In some implementations, for example as the one shown in FIG. 3, the front cover inserts are configured into two rib-shape components, Rib A 28 and Rib B 29. The ribs 28 and 29 protrude and extend along the inner side of the front cover 11. The two ribs 28 and 29 include two spring holding slots 26 and 27 to hold two ends of the spring 19 into the spring positioning slots in the back cover 12.

Figure 4:
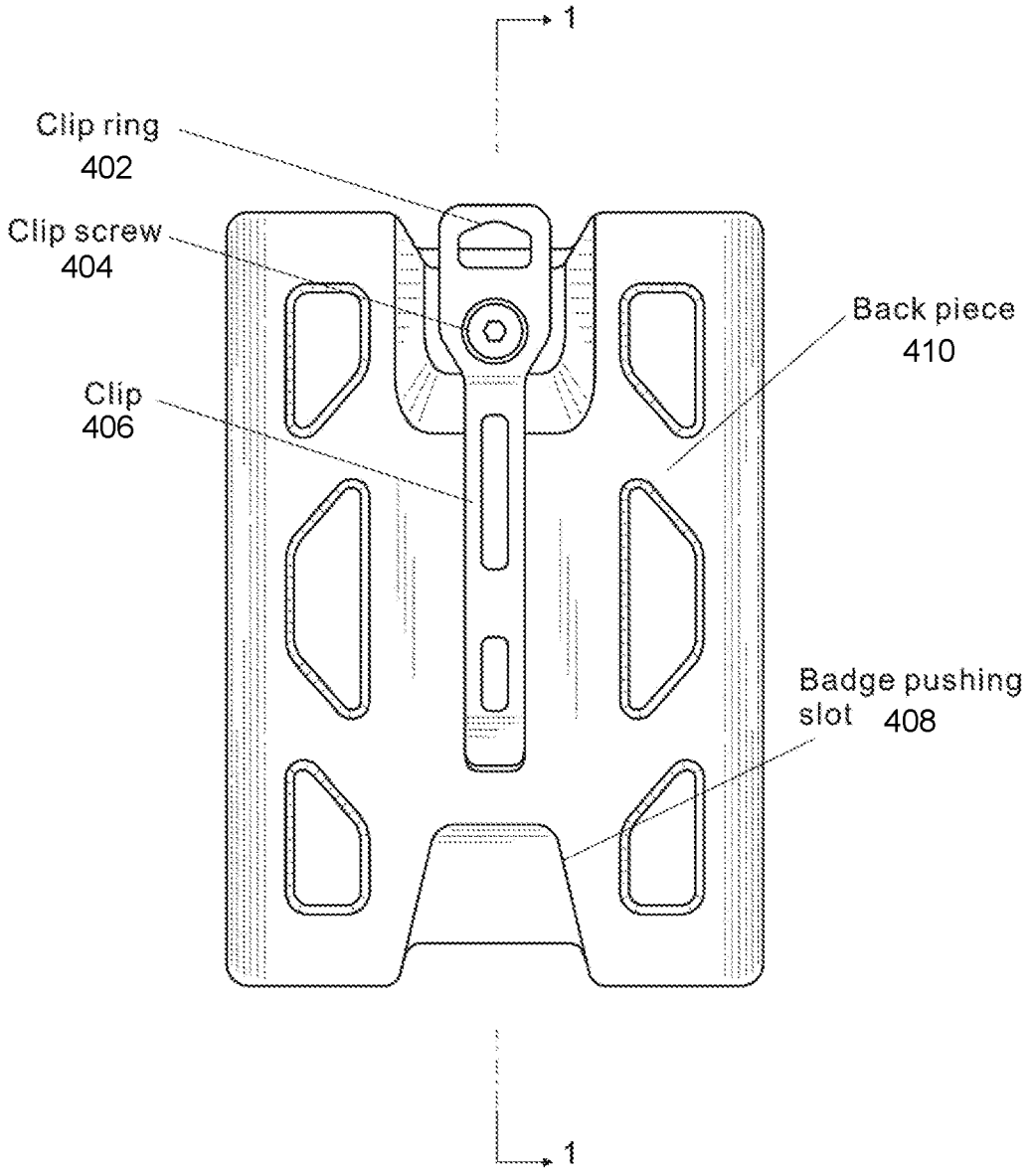
FIG. 4 is a block diagram illustrating a rear view of an example multifunctional card holder.

As shown in FIG. 4, the back cover 12 of a card holder embodiment 10 includes multiple hollowed-out regions, an ejecting slot 18 and has a clip 14 attached to the back cover 12 using a clip screw 16. The multiple hollowed out regions are technically advantageous, as they served to increase strength and reduce weight. In addition, when a badge is positioned inside the card holding space and next to the back cover 12, a sensor's detection wave may go through the hollowed-out region to detect the badge.

The clip 14 includes a slot 15 and a clip arm to improve the mobility and functionality of a badge holder. The slot 15 serves at least two technical functions. First, the slot 15 may hang the badge holder onto a user's personal items such as a lanyard or a carabiner and makes it convenient to carry, display, detach, and scan an ID badge. Second, the slot 15 allows a user to assemble the badge holder with other personal items such as key chains, transforming the badge holder into a more effective personal item organizer. The clip arm also serves at least two functions. First, the clip arm may clip the badge holder onto a user's personal items such as a belt, a shirt pocket, a suit lapel, a backpack strap, and a notebook cover. The clip arm expands the options for the user to carry her cards and display her ID. Similar to the slot 15, the clip arm allows the user to detach and scan her ID badge conveniently. Second, the clip arm may be made of elastic material and hold onto one or more cash bills to make the card holder into a compact wallet. The slot 15 and the clip arm allow users to carry the badge holders conveniently and organize their personal items in one compact place.

Figure 5:
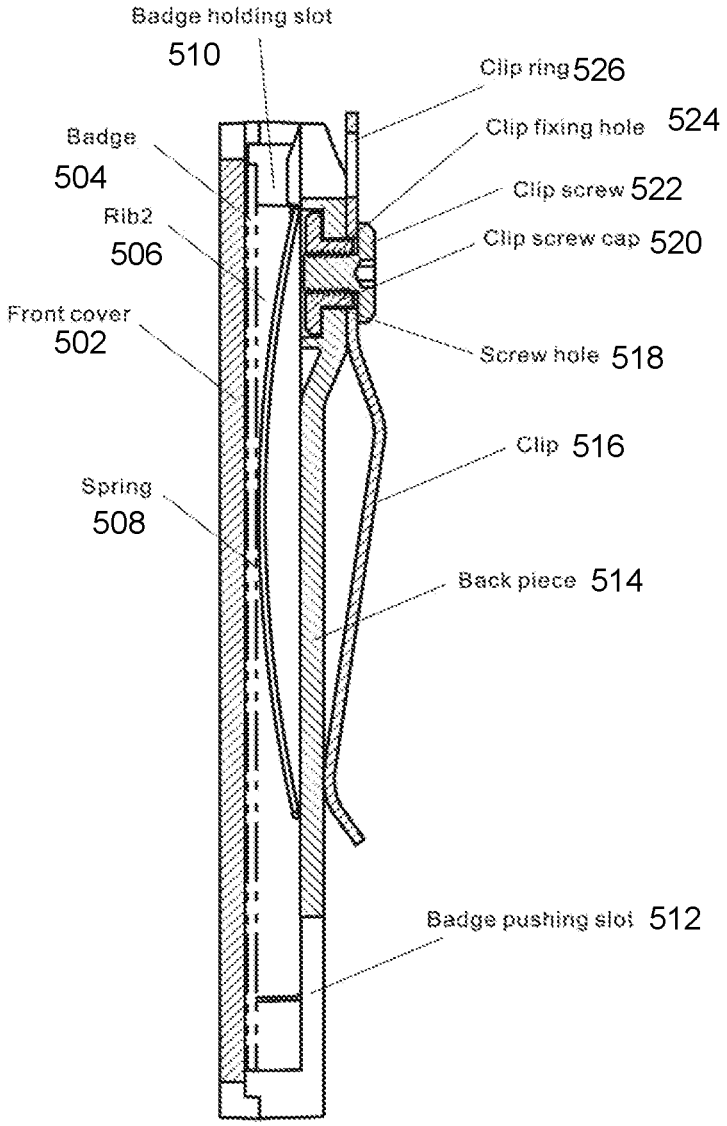
FIG. 5 is a block diagram illustrating a cross-sectional view taken along line A-A of the example multifunctional card holder shown in FIG. 4.

As shown in FIG. 5, an example multi-functional card holder includes a front cover 11 with one or more ribs 29, a spring 19, a card holding slot 13, a clip screw cap 17, a back cover 12, a clip 14 and a clip screw 16. The back cover 12 includes a hole 23 and an ejecting slot 18. The clip 14 includes a slot 15 and a clip fixing hole 22.

The spring 19 is of a curvy shape and pushes a badge 30 against the transparent front cover 11. A rib 29 on the front cover 11 may include one or more spring holding slots 27, which help to secure the spring 19 in place.

Figure 6:
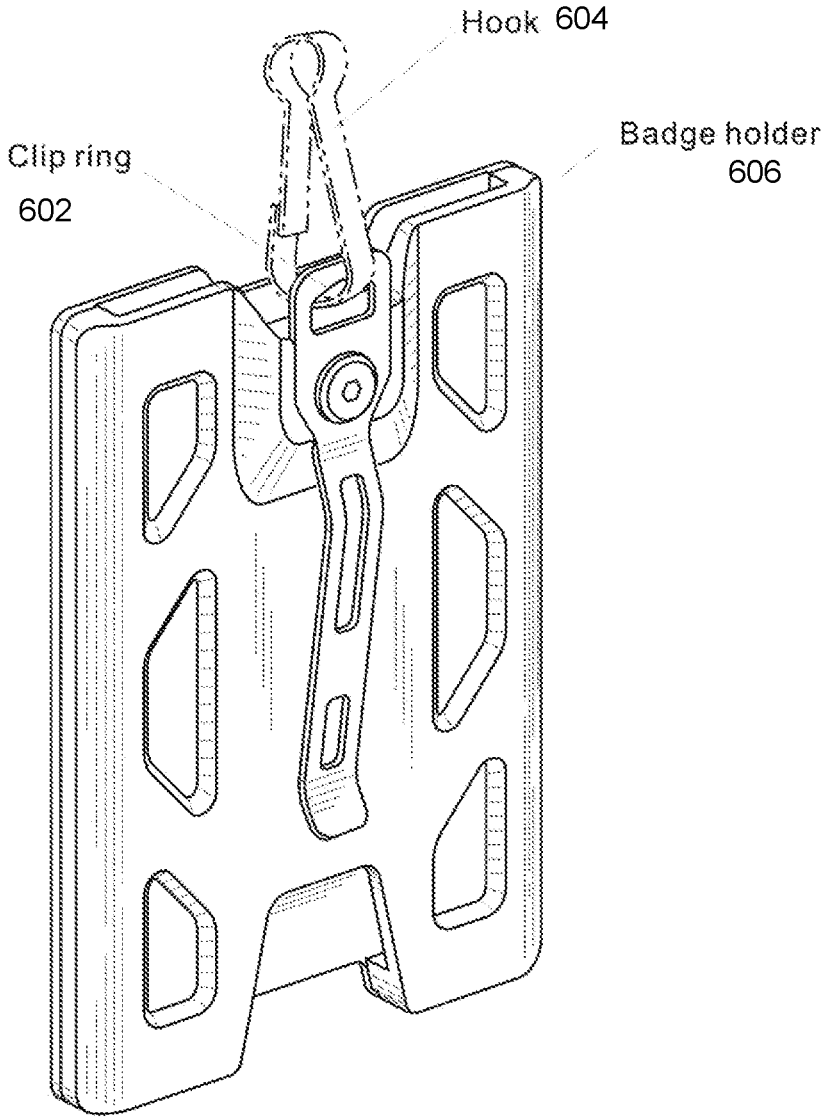
FIG. 6 is a block diagram of the perspective rear view of an example multifunctional card holder illustrating one means of attaching the card holder to an accessory.

FIG. 6 shows an example card holder 10, which includes a front cover 11, a back cover 12, a clip 14, and a clip screw 16. The slot 15 of the card holder 10 may attach to a hook 31. The opening of the slot 15 may be engineered to fit various standard hooks.

Figure 7:
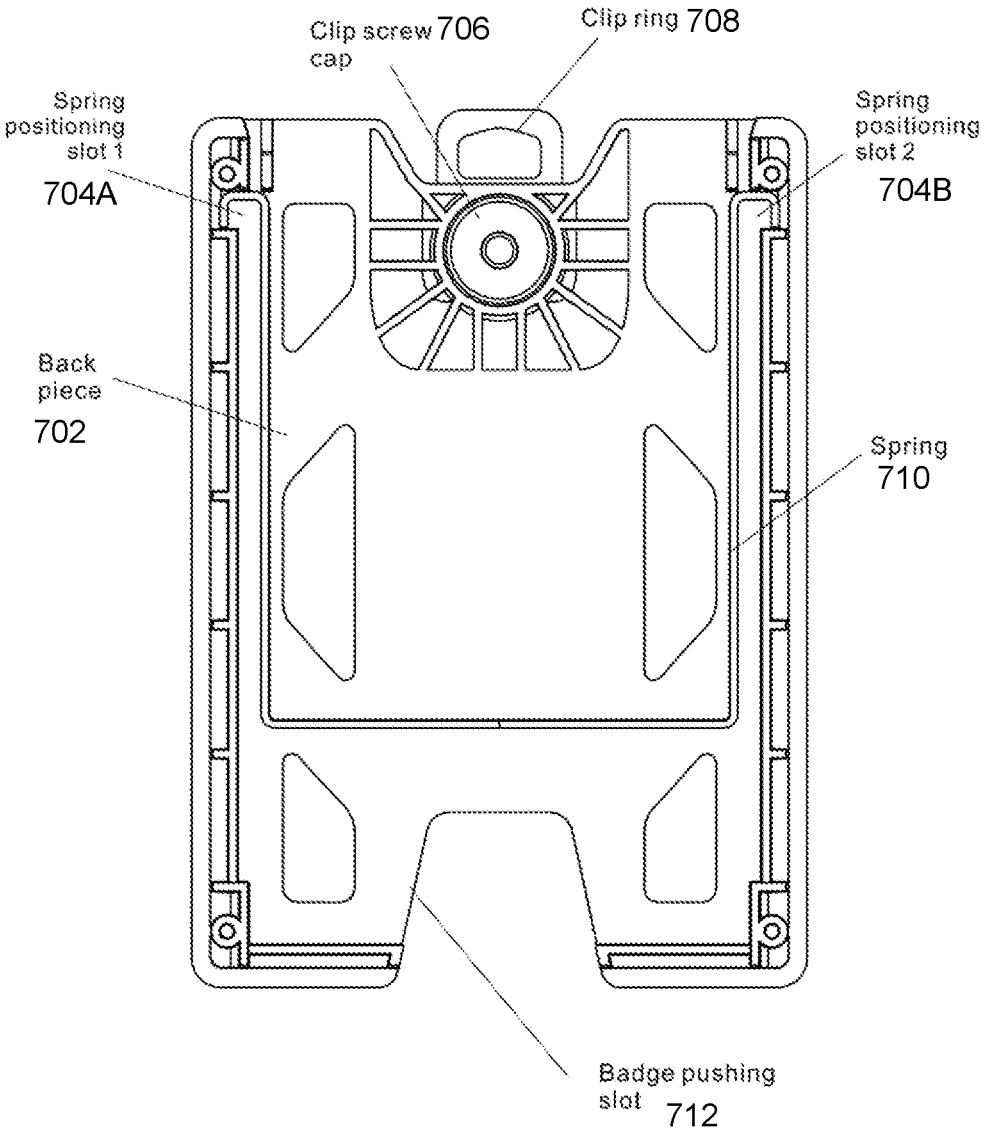
FIG. 7 is a block diagram illustrating a front view of the back piece of an example multifunctional card holder with its spring inserted into the back piece.

As shown in FIG. 7, in some implementations, the back cover 12 may have a spring 19 and a clip attached to it. The spring 19 may be of an "n" shape and includes two "n" shape ends that are capable of mounting the spring 19 into the two spring positioning slots 20 and 21 in the back cover 12.

The back cover 12 may include a strengthened structure around the clip screw cap 17. A clip with a slot 15 may be secured by a screw and the clip screw cap 17 with the reinforced structure around the clip screw cap 17. The reinforced structure helps to strengthen the connection between the card holder and its user. The back cover 12 may further include an ejecting slot 18.

Figure 8:
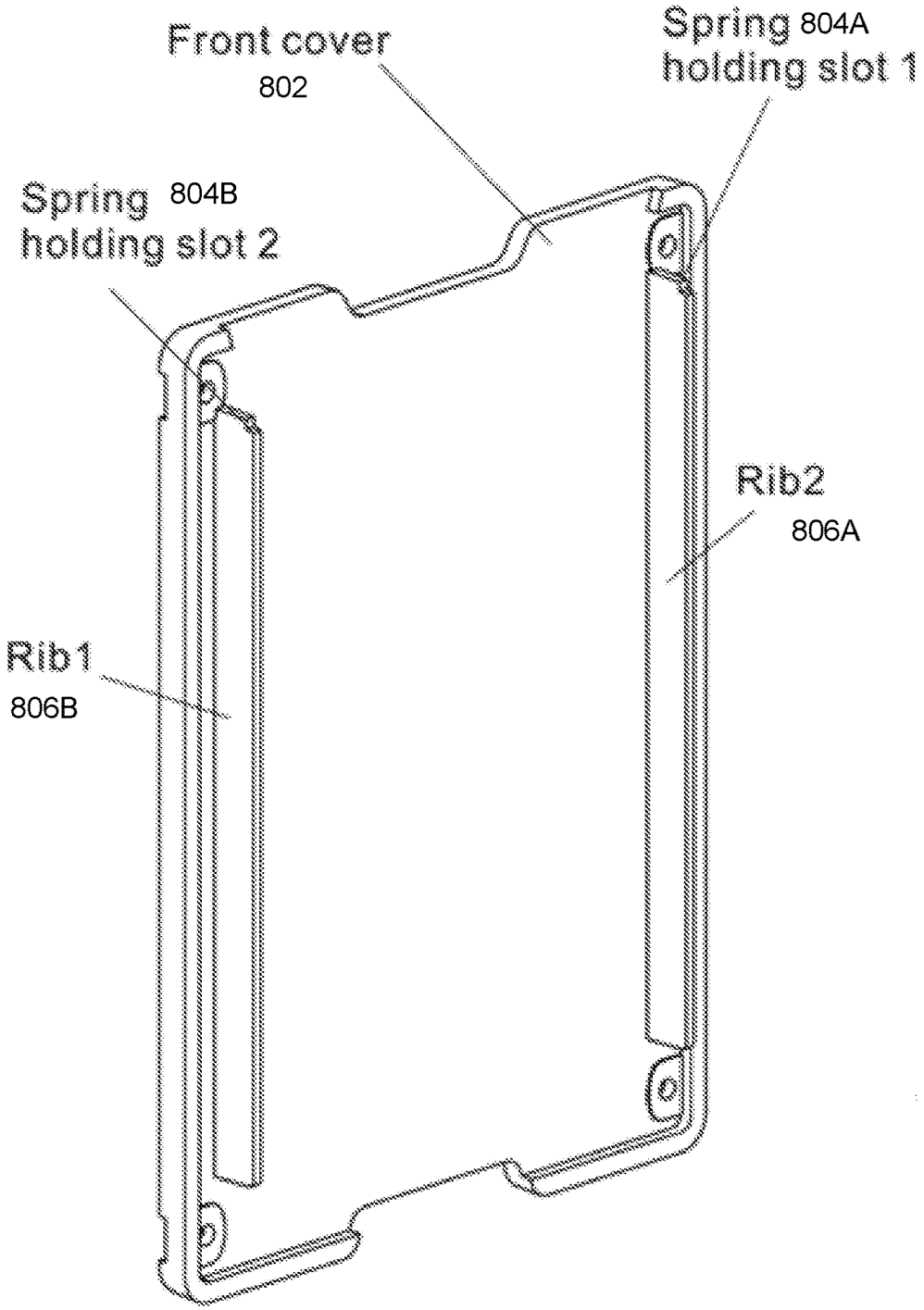
FIG. 8 is a block diagram illustrating a perspective rear view of the front cover of an example multifunctional card holder.

As shown in FIG. 8, in some implementations, the front cover 11 includes two ribs 28 and 29. The ribs 28 and 29, include spring holding slots 26 and 27 to hold two ends of a spring 19 (in FIG. 9) into the two spring positioning slots 20 and 21 (in FIG. 9) in a back cover.

Figure 9:
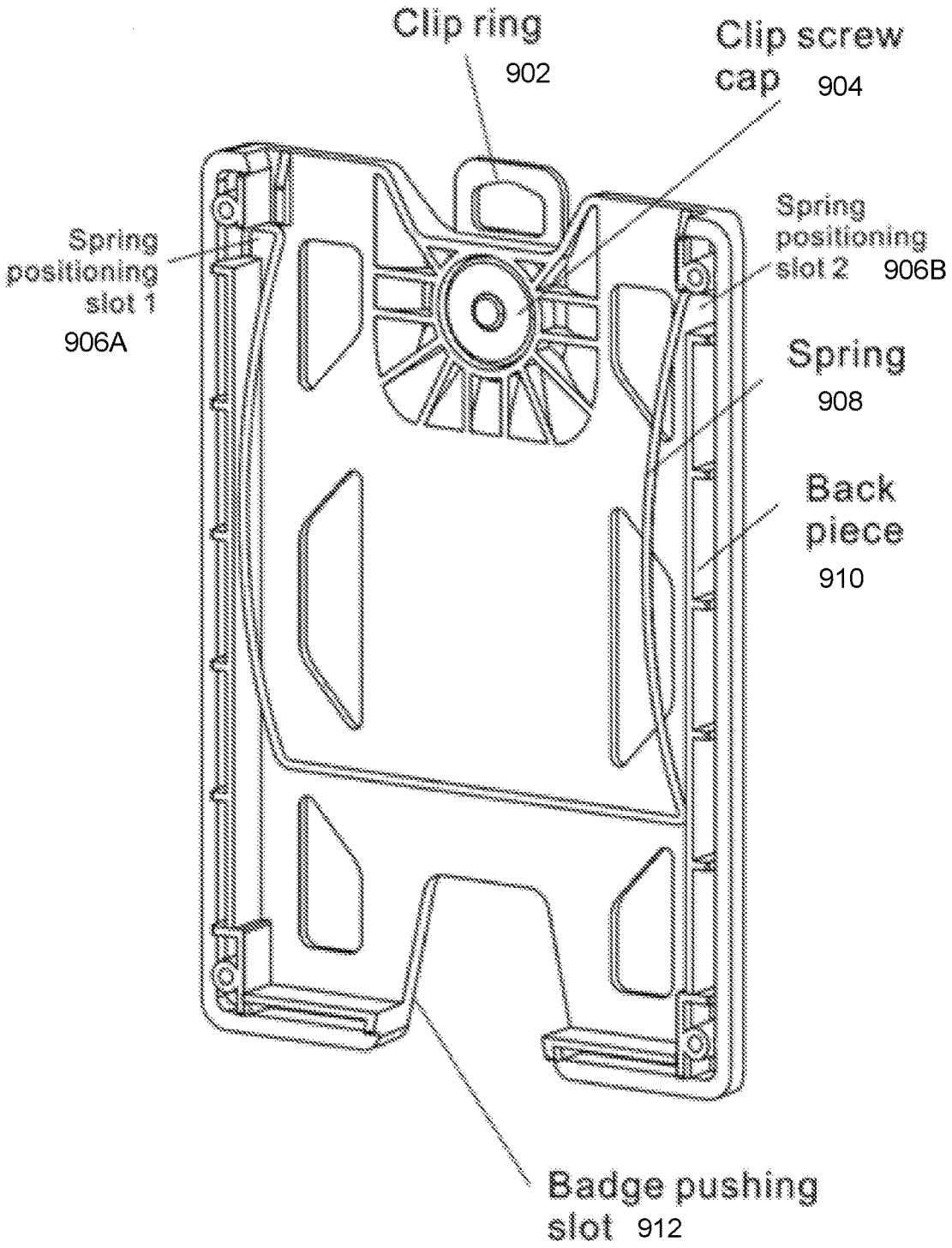
FIG. 9 is a block diagram illustrating a perspective front view of the back piece of an example multifunctional card holder with its spring inserted into the back piece.

As shown in FIG. 9, in some implementations, the back cover 12 may have a spring 19 and a clip attached to it. The spring 19 may be of an "n" shape and includes two "n" shape ends that are capable of mounting the spring 19 into the two spring positioning slots 20 and 21 in the back cover 12.

The back cover 12 may include a strengthened structure around the clip screw cap 17. A clip with a slot 15 may be secured by a screw and the clip screw cap 17 with the reinforced structure around the clip screw cap 17. The reinforced structure helps to strengthen the connection between the card holder and its user. The back cover 12 may further include an ejecting slot 18.

Figure 10:
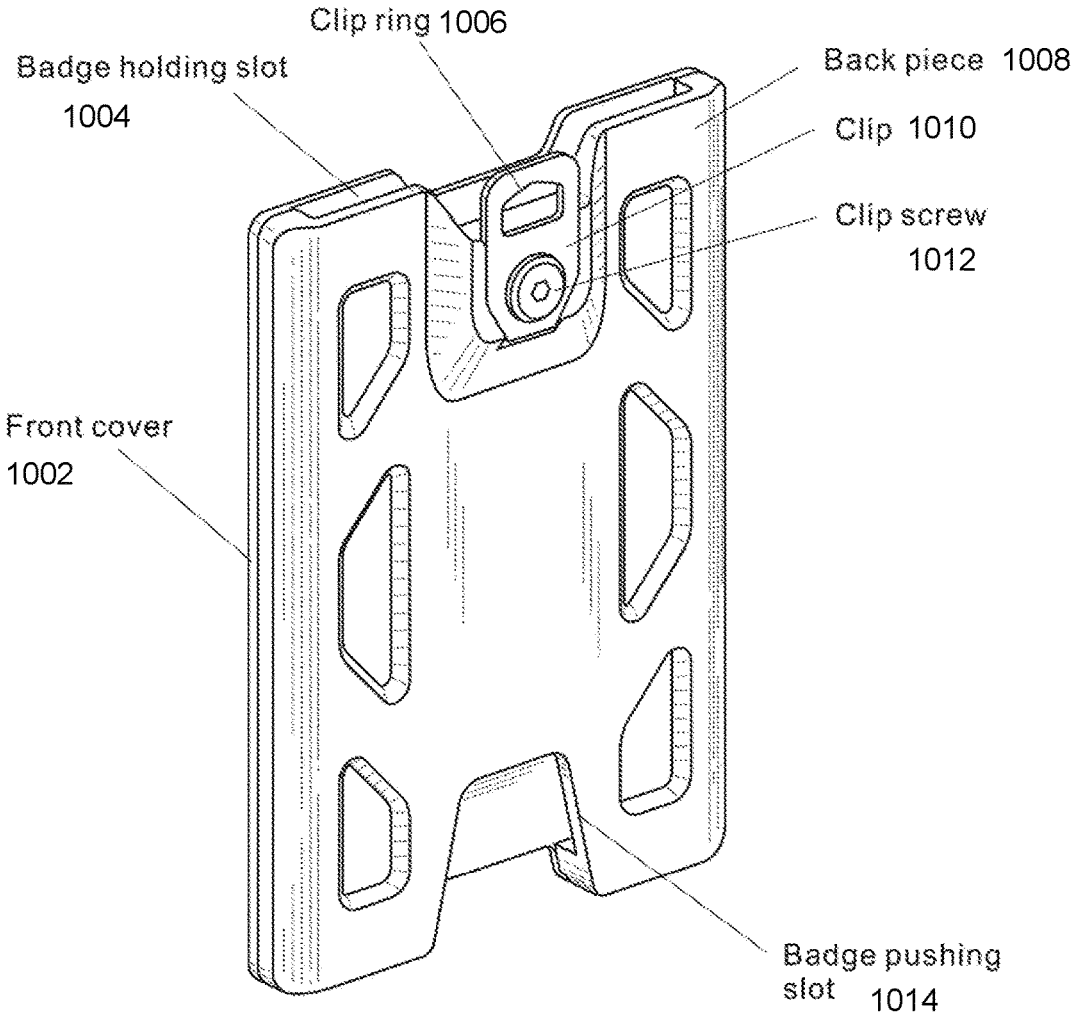
FIG. 10 is a block diagram of a perspective rear view of an example multifunctional card holder illustrating one embodiment of a card holder clip without a clip arm.

As shown in FIG. 10, an example card holder 210 includes a front cover 211, a card holding slot 213, a back cover 212 with an ejecting slot 218, a clip only with a slot 215, and a clip screw 216. The clip may exclude a clip arm to make the card holder lighter and more compact. This card holder provides several technical advantages. For example, a user would prefer this lighter embodiment if he has to hang an ID badge onto her person (e.g., the neck area) using a lanyard. A user may also prefer this more compact design if she has to fit the badge holder into a narrow space such as a tight pocket.

Figure 11:
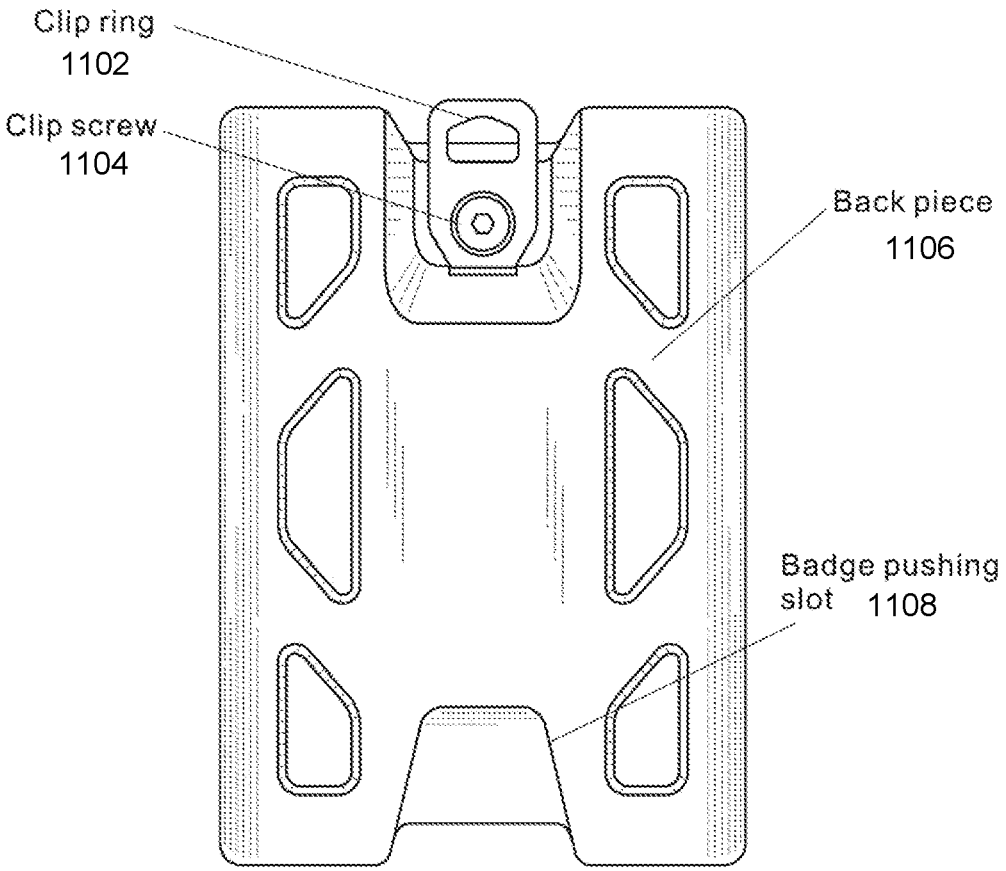
FIG. 11 is a block diagram illustrating a rear view of the example multifunctional card holder in FIG. 10.

Shown in FIG. 11 is another example card holder 210. The back cover 212 of the card holder 210 includes an ejecting slot 218 and a clip secured to the back cover 212 by a clip screw 216. The clip includes a slot 215, but is without a clip arm.

Figure 12:
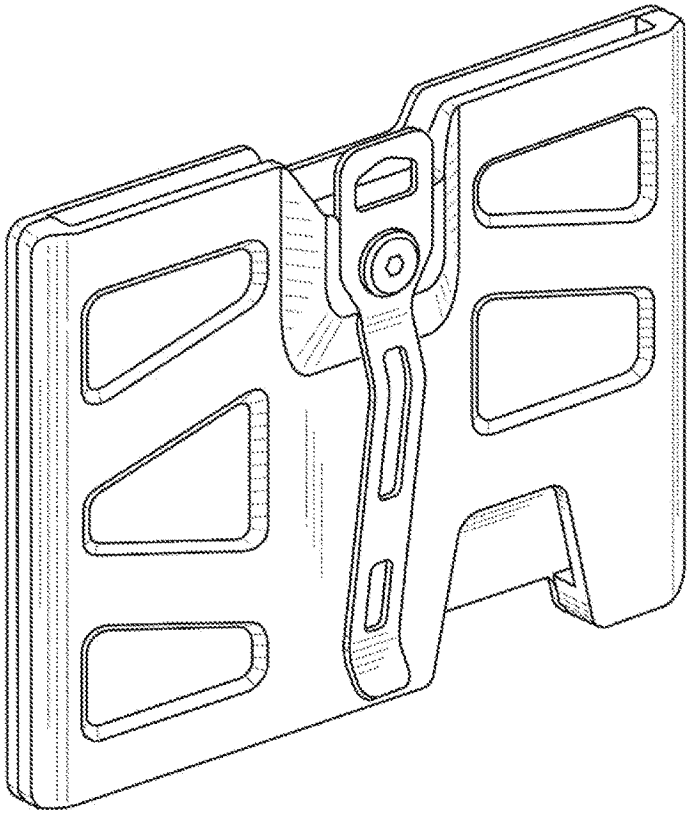
FIG. 12 is a block diagram illustrating a perspective rear view of an example multifunctional card holder whose clip is perpendicular to the long edge of the card holder.
Figure 13:
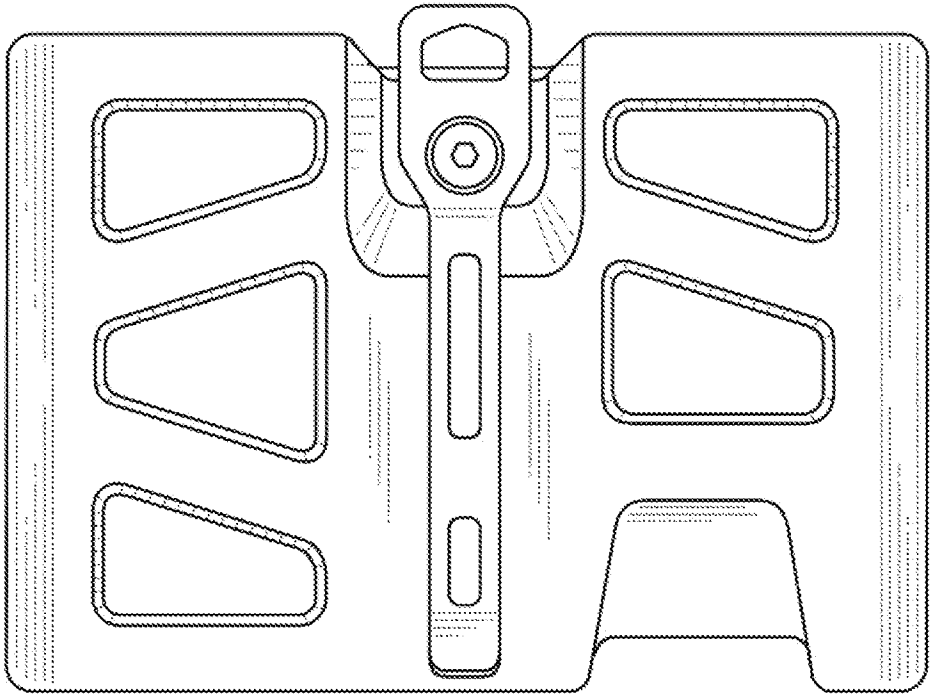
FIG. 13 is a block diagram illustrating a rear view of the example multifunctional card holder in FIG. 12.

For rectangular card holders that include clip arms, the clip arms may be perpendicular to either the short or the long edge of the card holders. As shown in FIGS. 12 and 13, in some embodiments, a card holder 310 includes a front cover 311, a back cover 312 with an ejecting slot 318, a card holding slot 313, a clip 314 with a slot 315, and a clip screw 316. The clip 314 of a rectangular card holder may include a clip arm perpendicular to the short edge of the card holder. Such an orientation may facilitate the identification of a user who uses horizontal ID badges.

Figure 14:
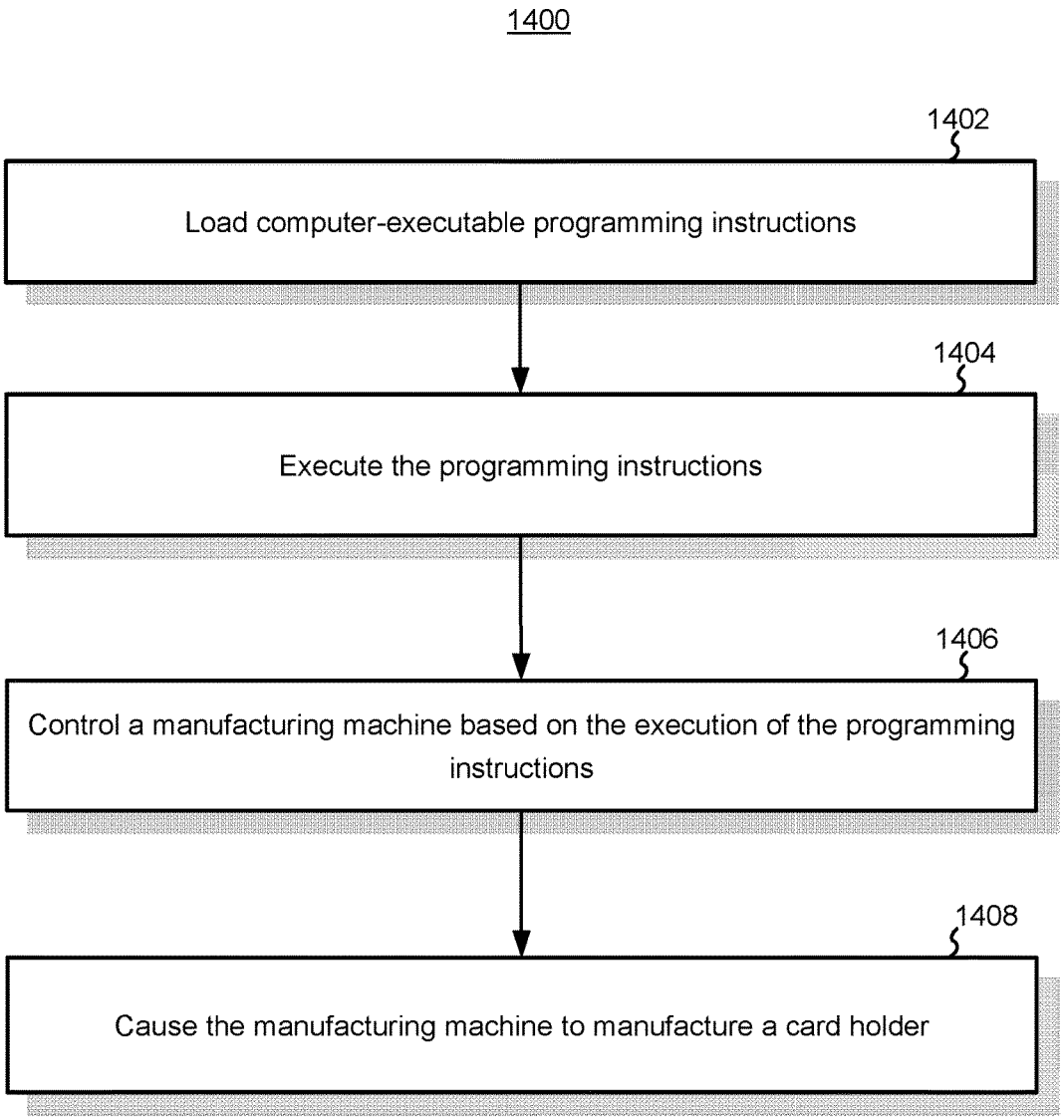
FIG. 14 is a flowchart illustrating an example method for manufacturing a multifunctional card holder.

FIG. 14 is a flowchart illustrating an example computer-implemented method 1400 for manufacturing a multifunctional card holder. The computer system 1400, when properly programmed, can execute the method 1400.

In some implementations, the method 1400 includes using a computer to load (502) computer-executable programming instructions from a non-volatile memory of the computer to a volatile memory of the computer.

After loading the programming instructions, the computer may execute (1404) the programming instructions using the volatile memory.

Based on the execution of the programming instructions, the computer may control (1406) a manufacturing machine, for example, a cutting machine, a molding machine, or a pressing machine.

By controlling the manufacturing machine, the computer causes (1408) the manufacturing machine to manufacture a multifunctional card holder as described in one or more of the implementations disclosed in the present disclosure.

Figure 15:
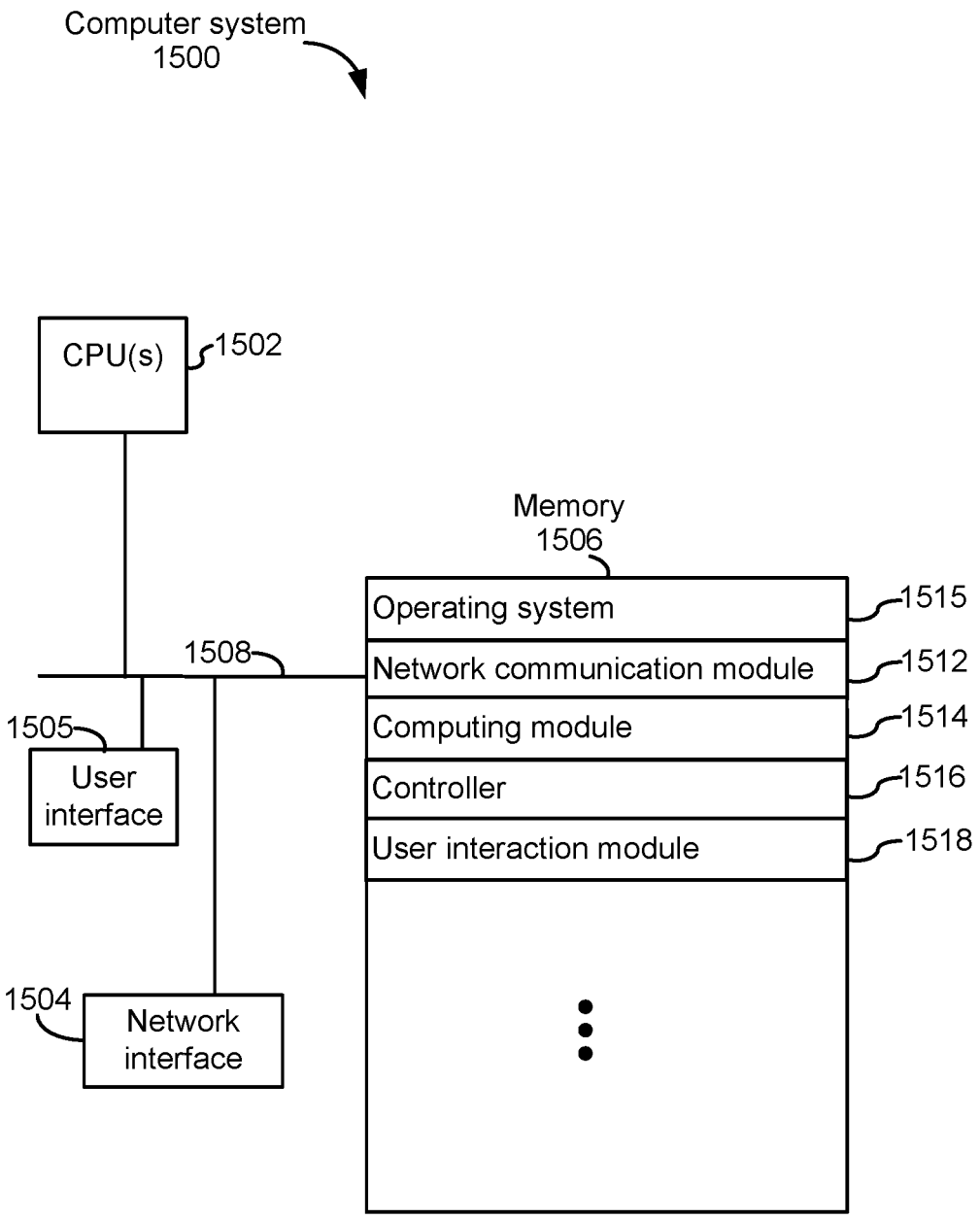
FIG. 15 is a block diagram illustrating an example computer system for manufacturing a multifunctional card holder.

FIG. 15 is a block diagram illustrating an example computer system 1500 for manufacturing a multifunctional card holder. The computer system 1500 in some implementations includes one or more processing units CPU(s) 1502 (also referred to as processors), one or more network interfaces, optionally a user interface, a memory 1506, and one or more communication buses 1510 for interconnecting these components. The communication buses 1510 optionally include circuitry (sometimes called a chipset) that interconnects and controls communications between system components. The memory 1506 typically includes high-speed random access memory, such as DRAM, SRAM, DDR RAM or other random access solid state memory devices; and optionally includes non-volatile memory, such as one or more magnetic disk storage devices, optical disk storage devices, flash memory devices, or other non-volatile solid state storage devices. The memory 1506 optionally includes one or more storage devices remotely located from the CPU(s) 100. The memory 1506, or alternatively the non-volatile memory device(s) within the memory 1506, comprises a non-transitory computer readable storage medium. In some implementations, the memory 1506 or alternatively the non-transitory computer readable storage medium stores the following programs, modules and data structures, or a subset thereof:

- an operating system 1510 (e.g., an embedded Linux operating system), which includes procedures for handling various basic system services and for performing hardware dependent tasks;
- a network communication module 1512 for connecting the computer system with a manufacturing machine via one or more network interfaces (wired or wireless);
- a computing module 1514 for executing programming instructions;
- a controller 1516 for controlling a manufacturing machine in accordance with the execution of programming instructions; and
- a user interaction module 1518 for enabling a user to interact with the computer system 1500.

One or more of the above identified elements may be stored in one or more of the previously mentioned memory devices, and correspond to a set of instructions for performing a function described above. The above identified modules or programs (e.g., sets of instructions) need not be implemented as separate software programs, procedures or modules, and thus various subsets of these modules may be combined or otherwise re-arranged in various implementations. In some implementations, the memory 1506 optionally stores a subset of the modules and data structures identified above. Furthermore, the memory 1506 may store additional modules and data structures not described above.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the implementation(s). In general, structures and functionality presented as separate components in the example configurations may be implemented as a combined structure or component. Similarly, structures and functionality presented as a single component may be implemented as separate components. These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first metal portion could be termed a second metal portion, and, similarly, a second metal portion could be termed a first metal portion, without changing the meaning of the description, so long as all occurrences of the "first metal portion" are renamed consistently and all occurrences of the "second metal portion" are renamed consistently. The first metal portion and the second metal portion are both metal portions but they are not the same metal portion.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

The foregoing description included example systems, methods, techniques, instruction sequences, and computing machine program products that embody illustrative implementations. For purposes of explanation, numerous specific details were set forth in order to provide an understanding of various implementations of the inventive subject matter. It will be evident, however, to those skilled in the art that implementations of the inventive subject matter may be practiced without these specific details. In general, wellknown instruction instances, protocols, structures and techniques have not been shown in detail.

The foregoing description, for purpose of explanation, has been described with reference to specific implementations. However, the illustrative discussions above are not intended to be exhaustive or to limit the implementations to the precise forms disclosed. Many modifications and variations are possible in view of the above teachings. The implementations were chosen and described in order to best explain the principles and their practical applications, to thereby enable others skilled in the art to best utilize the implementations and various implementations with various modifications as are suited to the particular use contemplated.

What is claimed is:

1. A card holder, comprising:

a transparent screen that is attached to a back piece, a spring inside a card holding space between the transparent screen and the back piece, where in the spring is of a curvy shape and connects to the back piece, wherein the spring is configured to hold one or more cards inside the card holding space by using the curvy shape to push the one or more cards against the transparent screen; and the spring is a single reversed "n" shape metal piece, the reversed single "n" shape metal piece includes:

(i) two first side metal portions located at parallel sides of the "n" shape metal piece, each of the two first metal side portions has an arch shape, and (ii) a second bottom metal portion connecting two bottom ends of the two first side metal portions, wherein the second metal bottom portion has a linear shape, the back piece; and a clip attached to the back piece outside the card holding space, wherein the clip includes a clip opening configured to be mechanically connected to an item of a user.

2. The card holder of claim 1, wherein the screen is rigid and attached to the back piece via one or more securing screws.

3. The card holder of claim 2, wherein the screen can be made of transparent polycarbonate and the screws are made of steel.

4. The card holder of claim 1, wherein the transparent screen is of a rectangular shape and the back piece is also of a rectangular shape except that one edge of the back piece includes an indented card pushing slot that allows a user to push a card from inside the card holding space to outside the card holding space.

5. The card holder of claim 4, wherein the second bottom metal portion included in the reversed single "n" shape metal piece is located above the indented card pushing slot.

6. The card holder of claim 5, wherein the spring further includes two "n" shape ends inserted into two spring positioning slots included in the back piece.

7. The card holder of claim 1, wherein the spring is configured to hold two or more cards inside the card holding space.

8. The card holder of claim 7, wherein the card holding space is configured to hold a RFID blocking card and one or more identification or payment cards.

9. The card holder of claim 1, wherein the spring is made of elastic metal.

10. The card holder of claim 1, wherein the transparent screen includes one or more inserts positioned to fit inside the space between the spring and edges of the back piece.

11. The card holder of claim 10, wherein the transparent screen includes two inserts having two spring holding slots positioned and configured to hold two ends of the spring into the two spring positioning slots in the back piece.

12. The card holder of claim 1, wherein the back piece includes one or more hollowed-out regions.

13. The card holder of claim 1, wherein the clip is made of an elastic material and is configured to clip to a user's clothing.

14. The card holder of claim 1, wherein the clip is attached to the back piece using a screw-nut structure.

15. The card holder of claim 1, wherein the clip includes a clip arm configured to hold one or more cash bills against the back piece.

16. The card holder of claim 15, wherein the card holder is of a rectangular shape with the clip arm perpendicular to a short edge of the card holder.

17. The card holder of claim 15, wherein the card holder is of a rectangular shape with the clip arm perpendicular to a long edge of the card holder.

18. The card holder of claim 1, wherein the clip includes a clip ring, but is without a clip arm.

* * * * *